United States Patent [19]

Eaton

[11] 4,093,846

[45] June 6, 1978

[54] MULTI-JET ELECTRODE BOILER

[75] Inventor: Milton Eaton, Shawinigan, Canada

[73] Assignee: General Electric Company, Carmel, Ind.

[21] Appl. No.: 666,894

[22] Filed: Mar. 15, 1976

[51] Int. Cl.[2] ..... H05B 3/60; H01C 10/02; F22B 1/30

[52] U.S. Cl. ..... 219/286; 219/289; 219/290; 338/80

[58] Field of Search ..... 219/271–276, 219/284–295; 338/80–86

[56] References Cited

U.S. PATENT DOCUMENTS

| | | | |
|---|---|---|---|
| 2,729,738 | 1/1956 | Eaton | 219/286 |

FOREIGN PATENT DOCUMENTS

| | | | |
|---|---|---|---|
| 168,622 | 7/1951 | Austria | 219/284 |
| 520,547 | 2/1921 | France | 219/291 |
| 632,231 | 7/1936 | Germany | 219/288 |
| 685,856 | 12/1939 | Germany | 219/284 |
| 897,317 | 11/1953 | Germany | 219/288 |
| 207,778 | 2/1940 | Switzerland | 219/288 |

*Primary Examiner*—A. Bartis

[57] ABSTRACT

An electrode boiler of the type in which each electrode is located in a steam generating compartment surrounded by a control compartment and the boiler load is regulated by transfer of water between these compartments. A manifold is mounted at the top of each steam generating compartment and is connected to a source of electrical energy. Water received by the manifold is formed into multi-jets that are directed downwardly in the steam generating compartment. The rate of steam generation is controlled, in part, by the height of water in the steam generating compartment. In one embodiment, the jets are directed inwardly to converge adjacent the center bottom of the chamber. In another embodiment, the jets are directed vertically downward and may be reformed at an intermediate point of their travel. Water is removed from the boiler and pumped to the manifolds. Normally this water is mixed with other water. The other water may be water which has been removed from the boiler and used for some purpose, such as space heating for instance. In one embodiment the piping between the control compartment and the manifold is discontinuous to provide a gap bridged only by the water.

15 Claims, 5 Drawing Figures

MULTI-JET ELECTRODE BOILER

BACKGROUND OF THE INVENTION

The present invention relates to improved steam boilers. More particularly, it relates to improved steam boilers of the electrode type in which electrodes are located in a steam generating compartment structure surrounded by a control compartment.

In typical prior art boilers, the electrodes are partially submerged in water and the amount of steam generation is controlled by varying the amount of electrode submersion. In such boilers, the water is heated and steam generated by the passage of an electric current through the water.

Make-up water must be added to the system periodically. It has been found that, in many areas, the mineral content of the available water supply is too high for efficient operation of such electrode boilers, particularly such boilers which utilize high supply voltages and high voltage to wattage ratios. For instance, such a boiler operated at 12 KV and with a rating of 1.5 MW is likely to be in such a class. In the past, operation of such boilers required the use of expensive demineralization equipment in order to reduce the mineral content of the supply water to the optimum range for boiler operation.

It is an object of the present invention to provide an improved electrode boiler which will operate efficiently with relatively high conductivity water.

It is another object of the present invention to provide an improved electrode boiler in which the electrodes are formed by jets of water.

SUMMARY OF THE INVENTION

In accordance with one form of the present invention, there is provided an electrode boiler of the type having at least one vertically elongated steam generating compartment surrounded by a control compartment and in which the load is regulated by transfer of boiler water between the compartments. Jet forming means is positioned to direct a plurality of electrode forming jets of water downward within the steam generating compartment. There is means to provide the jet forming means with water and means for connecting the jet forming means to a source of electrical energy. An electrical neutral is provided adjacent the bottom of the steam generating compartment so that electric current passing through the water, including the jets, will heat the water.

Conveniently, the jet forming means can be a manifold with a plurality of jet forming pipes. In a preferred embodiment, the jets are directed inwardly to converge near the bottom of the steam generating compartment. In another embodiment the jets are directed vertically downward and means may be provided for reforming the jets intermediate the high and low water levels of the steam generating compartment.

BRIEF DESCRIPTION OF THE DRAWINGS

The subject matter which I regard as my invention is particularly pointed out and distinctly claimed in the concluding portion of the specification. The invention itself; however, together with further objects and advantages thereof may be better understood by reference to the following description taken in conjunction with the accompanying drawings, in which:

DESCRIPTION OF THE PREFERRED EMBODIMENTS

Figure 1:
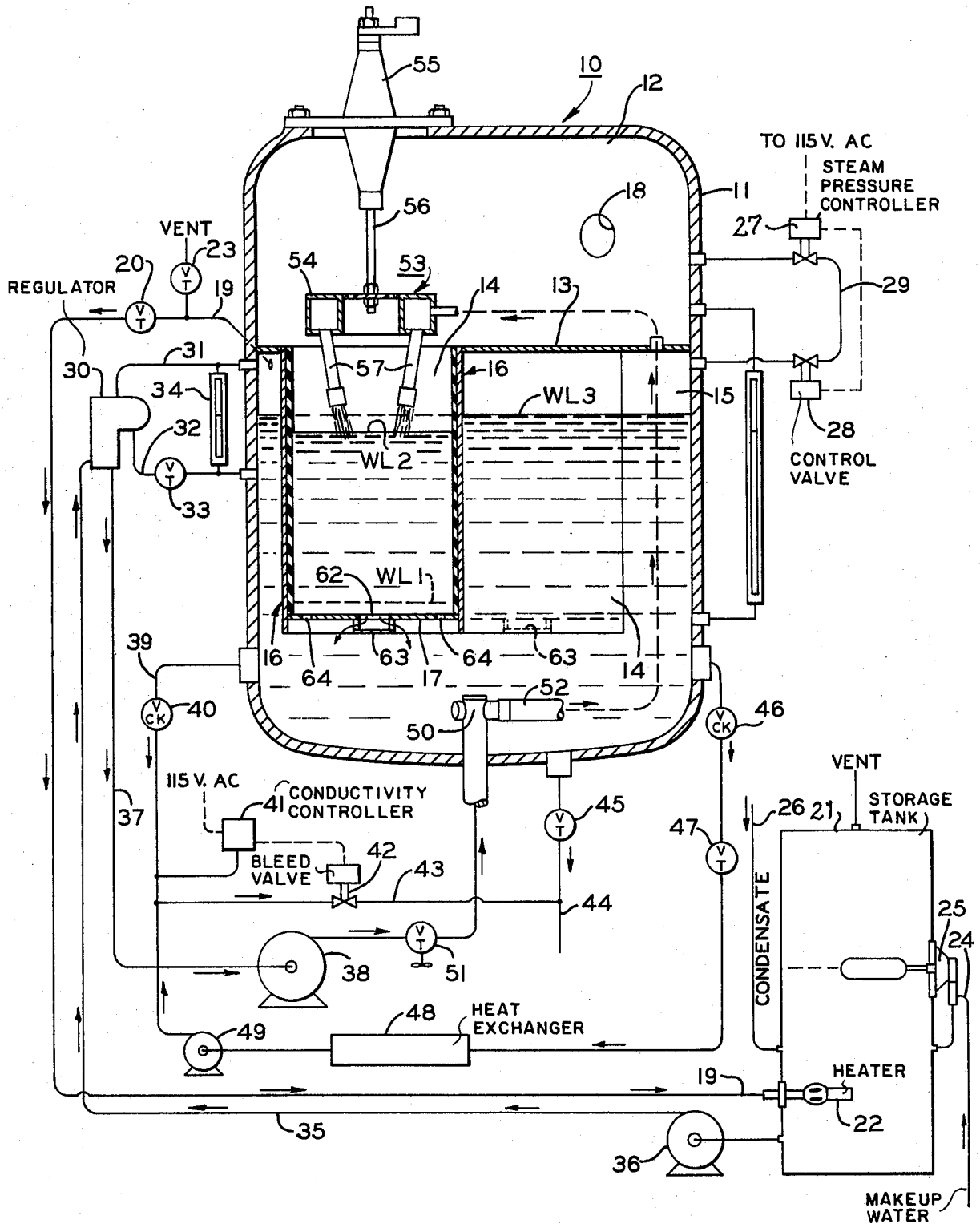
FIG. 1 is a sectional view of an electrode boiler incorporating one form of the present invention and showing the attachment of certain control and auxiliary equipment, the view being somewhat schematic in form and with some parts omitted for ease of understanding.
Figure 2:
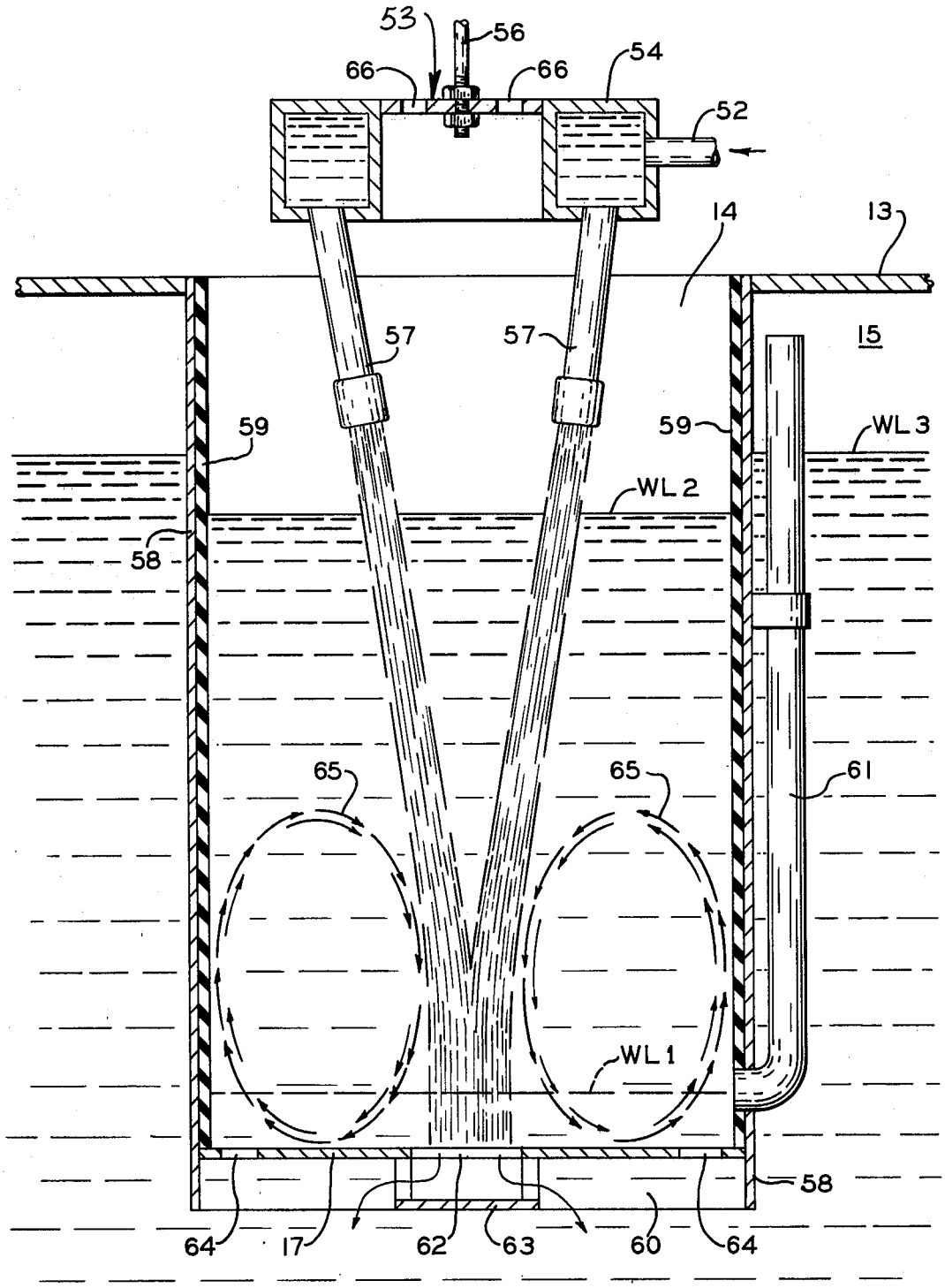
FIG. 2 is an enlarged, sectional view of a portion of the boiler of FIG. 1 illustrating additional details of one form of the present invention; the view being somewhat schematic in form.

Referring now to the drawings and particularly to FIGS. 1 and 2, there is illustrated, in somewhat schematic form, an electrode boiler incorporating one form of the present invention. The boiler 10 includes a shell 11 which is divided into an upper or steam outlet compartment 12 and a lower section by an electrically conductive diaphragm plate 13. The lower section includes one or more steam generating compartments 14 enclosed within a control compartment 15. Conveniently, with a three phase, Y connected electrical power supply, the boiler may incorporate three steam generating compartments. Each of the compartments would have one or more electrodes powered from one phase of the electrical supply. By the same token, all of the electrodes could be placed within one steam generating compartment. The single steam generating compartment could be cylindrical in shape or it could have a number of lobes, each of which contains one or more electrodes. Various steam generation compartment configurations, such as those briefly described above, are well known in the art. FIG. 1 illustrates a boiler with three steam generating compartments, two of which are illustrated.

Each steam generation compartment is formed by a cylindrical neutral side wall 16 which is joined to the diaphragm 13 and extends downwardly therefrom. The bottom of the steam generation compartment is formed by a bottom neutral wall 17. The bottom wall 17 has at least one opening therein to permit water communication between the steam generating compartment 14 and the control compartment 15.

Steam formed in the steam generation compartments 14 rises through the compartments into the steam outlet compartment 12. Steam is fed out of the boiler through outlet 18 to accomplish any desired use of the steam. The upper portion of the control compartment 15, which also is occupied by steam, is provided with an outlet tube 19. Steam exiting from control compartment 15 through tube 19 is controlled by throttling valve 20 and is fed to a feedwater storage tank 21. Conveniently, the steam so fed to the storage tank is introduced into the tank through a feedwater heater 22. The outlet tube 19 is connected to the atmosphere through a throttling valve 23, which releases air on start-up of the boiler.

The feedwater storage tank 21 is provided fresh makeup water through pipe 24 and float operated valve 25 so that the float operated valve 25 is effective to control the level of water within the feedwater storage tank. Additionally, condensate resulting from use of the steam withdrawn from the steam outlet compartment 12 through steam outlet 18 may be returned to the system through the feedwater storage tank by use of a condensate input pipe 26.

The boiler steam pressure controller 27 and a control valve 28 are interconnected and energized from a 115 volt AC source. They are connected in a pipe 29 which interconnects the steam outlet compartment 12 and the control compartment 15. The steam pressure controller 27 and control valve 28 vary the rate of admission of steam to the control compartment in response to boiler steam pressure variations. This provides a proportional - speed floating action for the actual water level WL2 within the steam generating compartments. This action results from the fact that the water level in the control compartment (WL3) and the water level in the steam generating compartments (WL2) are interdependent, as these compartments are in communication through the openings in the bottom walls 17 of the steam generating compartments.

A feedwater regulator 30 is connected to control compartment 15 at the highest normal level of WL3 by pipe 31 and connected to control compartment 15 below the lowest normal level of WL3 by pipe 32 and throttling valve 33. The pipes 31 and 32 are interconnected by sight tube 34. Sight tube 34 gives a visual indication of water level WL3. Feedwater regulator 30 is connected to the feedwater storage tank 21 by means of a pipe or conduit 35 and a pump 36. The pump 36 is effective, when energized, to withdraw water from the feedwater storage tank 21 and provide it to the feedwater regulator 30. A pipe 37 connects the feedwater regulator 30 with a supply pump 38.

A pipe 39 runs from the lower portion of the boiler shell to the pipe 37 and contains a check value 40. When water is drawn from feedwater regulator 30 through pipe 37 by pump 38, water is also drawn from the boiler through pipe 39 to pump 38. Pump 38 feeds the water to the boiler through a distributor 50. A manually adjustable throttling valve 51 is positioned in the pipe between the outlet of pump 38 and the distributor 50.

A conductivity controller 41 is connected to the pipe 39 is electrically connected to a bleed valve 42. The bleed valve is in a pipe 43 which is connected to the pipe 39. When the conductivity controller senses that water should be exhausted from the boiler system in order to add new water with different mineral content, the valve 42 is opened and water is bled from the boiler through the pipes 39 and 43. The pipe 43 connects to a pipe 44 which includes a control valve 45. Valve 45 is used to provide for blowdown of the boiler.

In addition to providing steam, which may be taken from the boiler through outlet 18, the boiler also provides high temperature water, which may be removed from the boiler and used for some purpose such as space heating and then returned to the boiler. Schematically, this is shown by a water circuit including a check valve 46, a throttling valve 47, a heat exchanger 48 (which could be a space heating convector) and a pump 49. These elements are connected in series in a piping system between the lower portion of control chamber 15 and pipe 37.

U.S. Pat. No. 2,729,738 and 3,824,372; both issued to Milton Eaton and both now assigned to General Electric Company, assignee of the present invention; show and describe additional details of control and auxiliary equipment for electrode boilers similar to that just discussed. Such controls, among others, are suitable for use with electrode boilers incorporating the present invention.

From the distributor 50 the water is fed to one or more pipes such as that shown at 52. These pipes conduct the water up into the steam outlet compartment 12 and supply it to a jet forming means such as that generally indicated at 53. Each jet forming means 53 includes a hollow, ring shaped manifold, such as that shown at 54. Each manifold is made from an electrical conducting material such as steel. Each manifold is mechanically supported and electrically connected to the electrical supply by means of input terminal 55 and terminal rod 56. Thus the water as it enters the manifold is at the voltage of the electrical input supply. There normally is at least one manifold per electrical phase. Thus, in a three phase system there would be at least three manifolds, normally one above each steam generation compartment.

The water supplied to each manifold through the associated pipe 52 will flow completely around the manifold. A number of jet forming pipe 57 are associated with each manifold 54. The pipes communicate with the interior of the manifold and serve to form the water in the manifold into a number of individual jets which are directed from the pipes 57 downwardly in the associated steam generating compartment 14. The pipes may be elongated nozzles or they may be separate tubes with nozzles at their distal ends. They may be separately formed and attached to the manifold or they may be formed integrally with the manifold. They must be long enough that the water flows from them as coherent streams rather than sprays and the term jet is used herein to connote a coherent stream.

The manifolds may be circular in shape and have a plurality of jet forming pipes. Conveniently, there can be eight pipes spaced at 45° from each other. If the boiler load is sufficiently large the manifolds may be provided with two or more concentric rows of jet pipes.

Turning now more particularly to FIG. 2, additional details of a steam forming compartment, illustrating portions of a preferred embodiment of the invention, will be described. As is typical with electrode boilers, the electrical neutral for the boiler is formed by the walls dividing the steam generating compartment from the control compartment. Normally this is done by making the walls of the steam generating compartment electrically conductive material. With the present invention, the neutral side wall 16 includes an outer wall element 58 which is connected to the diaphragm 13 and extends downwardly therefrom. The outer wall element is made of an electrically conductive material. The neutral side wall 16 also includes an inner wall element or a liner 59 which is made from an electrical insulating material and covers the inner surface of the outer wall element 58 from the diaphragm down to a point just above the bottom of the wall element 58. The neutral bottom wall 17 is formed of electrical conductive material and substantially closes off the bottom of the steam generation compartment 14 at the bottom edge of the inner wall element or insulator 59. The outer wall element 58 extends downwardly beyond the bottom wall 17 to form a skirt 60.

Each bottom plate 17 forms the basic neutral terminal in its associated steam generating compartment for the single phase circuit through the water, including the jets. The neutrals of the various bottom plates 17 are electrically interconnected by the associated outer wall elements 58 and diaphram plate 13 to form the neutral for the Y-connected, three phase circuit through the boiler water. In order to limit ground currents the diaphragm may be insulated from the shell 11.

A vent tube 61 connects the interior of the steam generation compartment 14 (at the lowest designated water level WL1) to the control compartment 15 (at a point above the highest level of water in the control compartment WL3). For ease of illustration, only two jet forming pipes 57 have been shown; however, it will be understood that a number of pipes may be spaced around the manifold 54. In accordance with the preferred embodiment, these pipes all are angled inwardly so that the jets of water tend to converge just above the center of the neutral bottom plate 17. The bottom plate 17 is provided with an opening 62 at its center, in alignment with the convergence point of the water jets. A deflector 63, constructed of electrically conductive material, is spaced below the bottom plate 17, is positioned in alignment with the opening 62, and is electrically connected to bottom plate 17. Additionally other openings 64 are spaced around the outer periphery of the bottom plate 17.

With the neutral structure and the electrical terminals 55 connected to a source of electrical energy, a potential exists across the water within each of the steam generation compartments and current flows through the water, including the water jets emanating from the pipes 57. This current heats the water and causes steam to form. Because of the insulator 59 the current must flow through the jets and the body of water below water level WL2 to the neutral formed by bottom plate 17. The deflector 63 and skirt 60 form part of the neutral and serve primarily to prevent electrode current from reaching the bottom of the boiler where it could cause pitting of the metal. The insulating lining 59 serves to prevent current flow between a jet contact with the water at WL2 and the neutral wall.

The water jets thus effectively form electrodes and take the place of the metal electrodes used in previous electrode boilers. While a substantial amount of energy dissipation ($I^2R$) for generating steam occurs in the main body of water below WL2, the steam generating portion of the circuit is mainly in the multi-jet electrodes. Control of steam generation is obtained by controlling the length of the jets. For instance, the length of the jets and their electrical resistance is increased as WL2 is lowered, thereby decreasing the boiler load. The floating or actual water level, WL2, in the steam generating compartments rises and falls in response to controller action which regulates the steam pressure in the control compartment. A U tube effect causes WL2 to assume a level at which WL3 minus WL2 is a measure of the difference between the steam pressure in the two compartments, with compensation for the effect of other forces. In jet flow electrode boilers utilizing metal electrodes the upward thrust of the jets of water and the realease of steam from the water surrounding the electrodes causes WL2 to rise higher than the level corresponding to the difference in steam pressures. The effect is the opposite in a multi-jet electrode boiler. With the present construction, the thrust of the jets of water is downward and the difference between the control pressures is limited. Means is provided to prevent the rise of WL2 from being impeded by the downward thrust of the jets. This is accomplished in part by the opening 64 spaced around the outer periphery of the bottom wall 17. The inwardly angled flow of the jets through the body of water and out the opening 62 induces an eddy current type flow within the water, as indicated by arrows 65. The openings 64 allow water to be drawn into the steam generating compartment 14 by this eddy current action. This assists the controller action in maintaining water level WL2 at the proper position. Alternatively the downward thrust of the jets may be compensated for by reducing the size of the openings in plate 17 so that the jetted water tends to be held in the steam generating compartment and WL2 can be made steady or lowered only by controller action which maintains the steam pressure in the control compartment lower than the boiler steam pressure. The difference in steam pressures causing upward movement of WL2 is limited to zero at which the upward force is WL3 minus WL2 whereas the downward force owing to difference in steam pressures may be increased by decreasing the steam pressure in the control compartment practically to zero or until the steam in it is all replaced with boiler water.

Additionally, the manifold 54 is provided with one or more openings, such as that shown at 66. This allows steam formed within the area encompased by the water jets to rise easily through the manifold mechanism so that the rising steam does not disturb the pattern of the jets.

The number of jets is controlled by the surface area per unit length required for the desired release of steam. Since the surface area of each jet per unit length is proportional to its diameter and the flow is proportional to the diameter squared, the minimum flow for a given surface is obtained by the use of multiple jets of relatively small diameter. However, the minimum diameter is limited by the smallest size that will provide required jet stability to result in coherent streams for the length of the jets.

The throttling valve 51 is adjusted to minimize the amount of boiler water that is pumped into the jet manifolds in order to provide normal jet flow and the required amount of cooling effect to prevent the occurrence of steam in the water in the supply pipes 52. A suitable throttling adjustment of the valve 51 is one at which at further closure would result in an observable decrease in the electrode current. As a guide, the water taken from the boiler and from an outside source, such as the feedwater storage tank 21 or the heat exchanger 48, should be pumped through the multi-jet electrodes at a rate at which less than about 10 percent of the water is evaporated during each passage.

If the pump 38 merely removed water from the boiler through pipe 39 and returned it through distributor 50 and pipes 52, the heating effect on the water in the pipes 52 caused by the flow of electricity therein might cause steam to be generated in the pipe. This would cause erratic operation. The water being fed to the distributor 50 should be cooled somewhat from the normal boiler operating temperature that the water in pipe 39 will exhibit.

This cooling can be accomplished by drawing water from the feedwater supply storage tank 21 through the feedwater controller 30 and pump 36. Since the tank 21 is vented and maintained at atmospheric pressure, the temperature of the water in it is appreciably lower than the boiler steam temperature. Alternatively, or in addition, the high temperature water removed from the boiler and fed through a heat exchanger 48 will be at a lower temperature than the boiler water and may be used to reduce the inlet temperature. Thus while the water removed from the boiler and returned to provide the multi-jet action must be cooled by some externally supplied water, this external water supply can, in effect, be water which is normally associated with the boiler itself.

Figure 3:
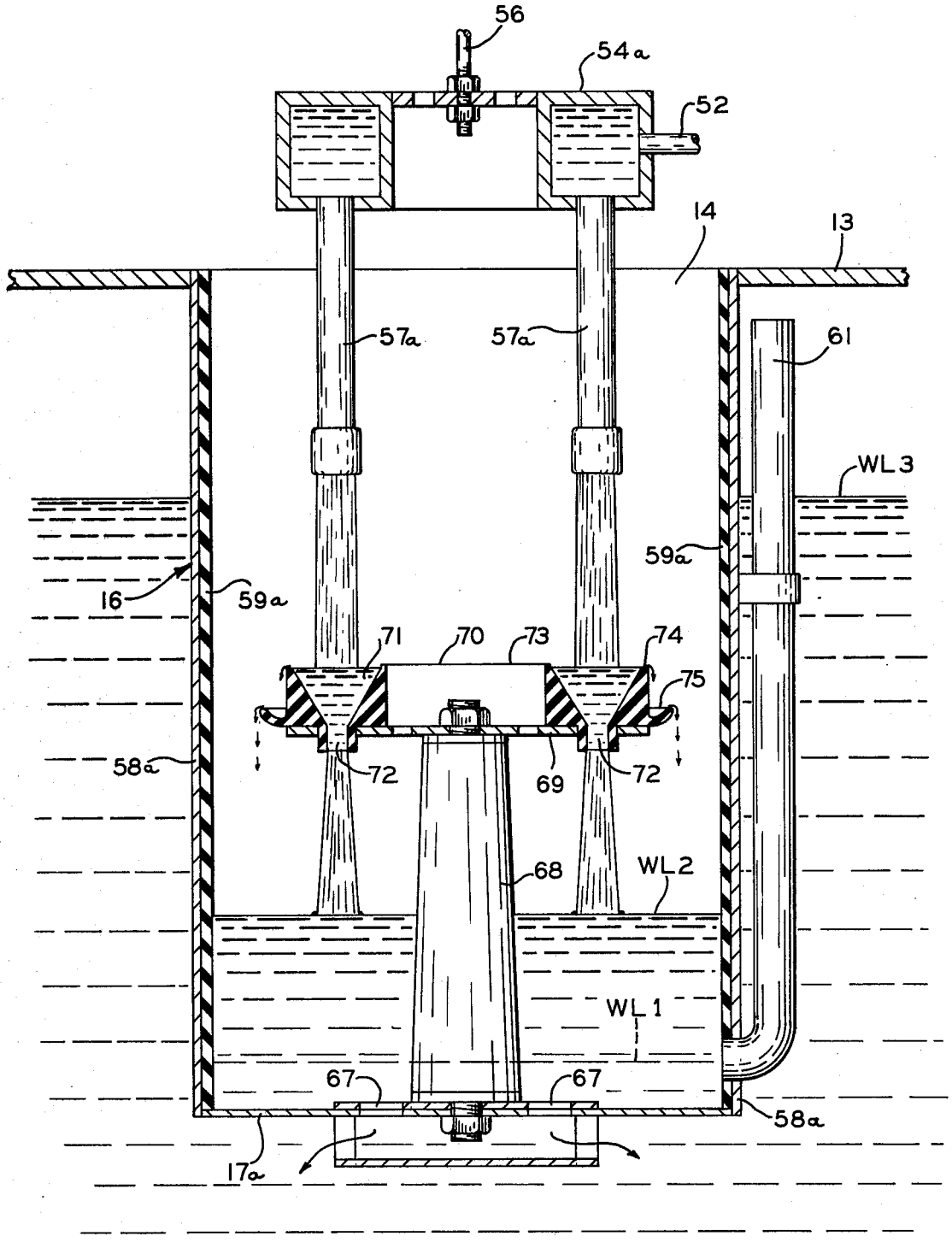
FIG. 3 is an enlarged, sectional view similar to FIG. 2 but showing details of another form of the present invention.

Referring now to FIG. 3, there is shown a slightly modified structure incorporating another embodiment of the present invention. The jet forming manifold 54*a* is the same as manifold 54 of FIGS. 1 and 2, except that the jet forming pipes 57*a* are shaped to direct the jets of water vertically downward in the steam generating compartment 14 rather than angling them toward the center of the compartment. The structure of the neutral walls is slightly different. The outer side wall element 58*a* may be the same length as the inner side wall element 59*a* so that the inner side wall element extends essentially the full length of the outer side wall element. The bottom neutral 17*a* is the same as 17 except for the placement of the water flow holes. They take the form of a number of openings such as those shown at 67 which are spaced about a post 68. The post 68 is formed of electrically insulating material and extends upwardly in the steam generating compartment. A support plate 69 is mounted to the top of the insulating post 68 and supports a ring shaped jet reforming member 70. The reforming member includes a trough portion 71, which is positioned to receive the jets of water coming from the pipes 57*a* and has reforming openings 72 which reform the water into new jets. The openings 72 are in alignment with the pipes 57*a* and are slightly smaller than the pipes. The inner wall 73 of the trough is higher than the outer wall 74 so that any excess water will flow over the outer wall 74 where it will impinge upon an outwardly and slightly upwardly extending wall 75. The wall 75 breaks up the overflow into individual droplets that will drop to the body of water in the lower portion of the compartment without conducting electric current.

This reforming mechanism may be utilized if the normal level of water in the steam generating compartment is far enough away from the manifold that the electrode forming jets of water tend to lose their continunity and becomes sprays. The mechanism also serves to absorb downward thrust of the jets. This reduces impedance to the upward movement of WL2 by controller action.

Figure 4:
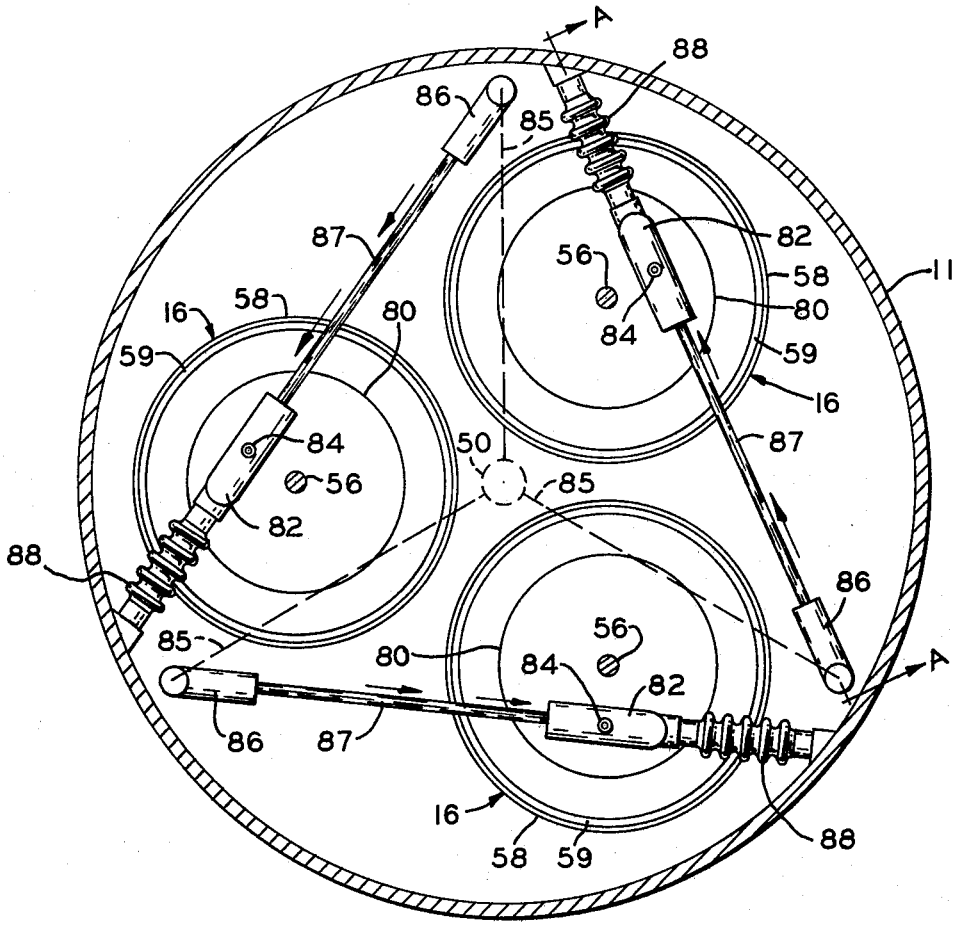
FIG. 4 is a somewhat schematic plan view, looking downward within the steam outlet compartment but illustrating another embodiment of the present invention.
Figure 5:
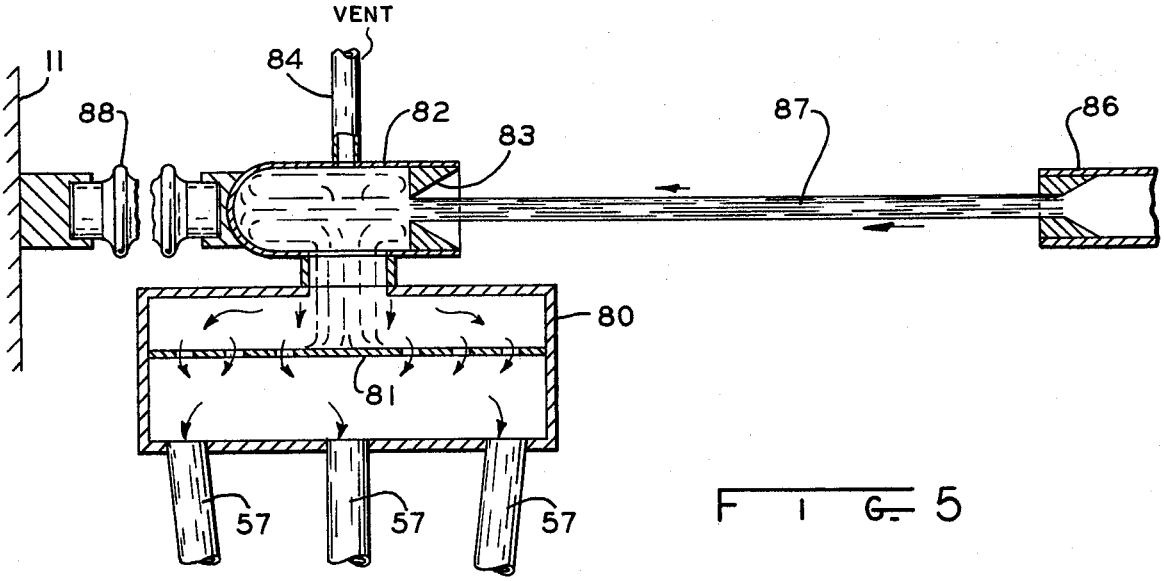
FIG. 5 is an enlarged sectional view as seen along line A-A in FIG. 4.

The manifolds 54 are essentially at supply potential while the shell 11, and thus the distributor 50, is at neutral potential. In the embodiments of FIGS. 1–3, this requires that the pipes 52 either be formed from suitable electrical insulative material or that the pipes be provided with an insulative lining and an insulative coupling to the associated manifolds. In some installations the operating conditions may be unsuitable for the use of insulating materials to convey water to the jet manifolds. FIGS. 4–5 illustrate another embodiment of the present invention in which high velocity jets of water are used in place of the insulation.

Referring now more particularly to FIGS. 4–5, the boiler is essentially the same as previously described except for the mechanism to deliver water to the manifolds. Like numbers are used on like parts. Each of the modified manifolds 80 is suspended from and electrically connected to one of the terminal rods 56. Each of the manifolds has a number of jet forming pipes 57. A perforated baffle 81 extends horizontally across the inside of each manifold. Additionally a jet terminal 82 extends from the top of each manifold. The terminals are hollow and communicate with the interior of the associated manifold. Each terminal has a flared opening 83 and a vertically extending vent tube 84.

From the distributor 50 a number of pipes (indicated by dash lines 85) extend upwardly into the steam outlet compartment. Each of the pipes 85 terminates in a nozzle 86 which is in alignment with the flared opening 83 of a corresponding one of the jet terminals 82.

Water pumped through the manifold 50 is emitted from the nozzle 86 and flows across the gap into the corresponding terminal 82 as a stream 87. Preferably, the pumping action is sufficient and the nozzles 86 are so formed that the streams are of high velocity. This provides minimal cross sectional area and relatively long length, thus resulting in maximum electrical resistance and minimal current flow.

An insulative spacer 88 is positioned between each terminal 82 and the shell 11 and opposes the thrust of the stream 87. Entrained stream or or gases in the streams 87 are vented through vents 84. The baffle 81 helps distribute the water to the various pipes 57.

While in accordance with the patent statutes there has been described what at present is considered to be the preferred embodiments of this invention, it will be obvious to those skilled in the art that various changes and modifications may be made therein without departing from the invention. It is the applicant's intention in the following claims to cover all such equivalent variations as fall within the true spirit and scope of the invention.

What I claim is new and desire to secure by letters Patent in the United States is:

1. An electrode boiler comprising: at least one vertically elongated steam generating compartment surrounded by a control compartment; means for transferring water between said compartments to provide a regulated water level in said at least one steam generating compartment for regulating the load; jet forming means positioned above the regulated water level in said at least one steam generating compartment and formed to direct a plurality of electrode forming jets of water downwardly within said at least one stream generating compartment for impingement on the surface of the water therein; means for providing said jet forming means with a supply of water; means for connecting said jet forming means to a source of electric energy and means forming an electric neutral positioned below the minimum regulated water level in said at least one steam generating compartment; so that electric current flow through the water, including the electrodes formed by the jets of water, will heat the water.

2. An electrode boiler as set forth in claim 1; wherein said jet forming means includes a manifold positioned adjacent the upper end of the at least one stream generating compartment and a plurality of jet forming pipes; said manifold being adpated to receive the water and direct it to said jet forming pipes.

3. An electrode boiler as set forth in claim 2; wherein said jet forming pipes are adpated to direct the jets of water downwardly in said at least one steam forming chamber in a pattern which converges adjacent the lower end of said steam generating compartment.

4. An electrode boiler as set forth in claim 3; wherein said at least one steam generating compartment includes a generally vertically extending side wall and a bottom wall constructed from an electrically conductive material; said means forming an electric neutral including said bottom wall; the inner surface of said side wall above said bottom wall being covered with an electrically insulative material; said bottom wall defining a first opening therethrough for the passage of water between said compartments said first opening being in alignment with the area of convergence of the jets of water; and a deflector of electrically conductive material is mounted across said first opening spaced below and electrically connected to said bottom wall.

5. An electrode boiler as set forth in claim 4, wherein said bottom wall defines a plurality of additional openings therethrough, spaced outwardly from said first opening, for the passage of water between and compartments and said side wall includes a skirt portion extending downwardly beyond said bottom wall.

6. An electrode boiler as set forth in claim 2, including piping to deliver water to said manifold, said piping terminating in a nozzle spaced from the water inlet means of said manifold so that the water flows from said nozzle to said manifold water inlet means as a high velocity stream.

7. An electrode boiler as set forth in claim 6 wherein said manifold water inlet means includes a terminal positioned to receive the water and direct it into the manifold and a perforated baffle for directing water to said plurality of jet forming pipes.

8. An electrode boiler as set forth in claim 2; wherein said jet forming pipes are adapted to direct the jets of water substantially vertically downward in said at least one steam forming chamber.

9. An electrode boiler as set forth in claim 8 further including reforming means supported from said electric neutral by electrically insulating means; said reforming means being in spaced relationship with each of said jet forming means and said electric neutral and positioned intermediate the minimum and maximum regulated water levels of said at least one steam generating compartment; said reforming means includes a trough portion to receive the jets of water from said jet forming means and a plurality of additional jet forming pipes for directing reformed jets of water downwardly from said reforming means.

10. An electrode boiler as set forth in claim 9; wherein said jet forming pipes of said manifold and said additional jet forming pipes of said reforming means are positioned in substantial alignment.

11. An electrode boiler as set forth in claim 1; wherein said at least one steam generating compartment includes a generally vertically extending side wall and a bottom wall constructed from an electrically conductive material; the inner surface of said side wall being covered, over at least most of its length, with an electrically insulative material so that said walls form said electric neutral positioned below the minimum regulated water level in said at least one steam generating compartment; said bottom wall defining at least one opening therethrough to provide said means for transferring water between said compartments.

12. An electrode boiler as set forth in claim 11; wherein a deflector of electrically conductive material is mounted across said at least one opening in said bottom wall and is spaced below said bottom wall.

13. An electrode boiler as set forth in claim 1, further including recirculation means for removing water from the boiler, mixing it with other water and providing the mixed water to said jet forming means.

14. An electrode boiler as set forth in claim 13; wherein said recirculation means includes a pump for moving the water and a throttling valve for controlling the flow of water; said throttling valve being closed to an extent that further closure will result in an observable reduction in the electrode current.

15. An electrode boiler as set forth in claim 13; wherein said recirculation means is effective to provide water to said jet forming means at a constant adjustable rate at which not more than 10% of the water is evaporated during each passage.

* * * * *